US010184159B2

(12) United States Patent
Holleck et al.

(10) Patent No.: US 10,184,159 B2
(45) Date of Patent: Jan. 22, 2019

(54) METHOD FOR PRODUCING A COLD-ROLLED FLAT STEEL PRODUCT FOR DEEP-DRAWING AND IRONING APPLICATIONS, FLAT STEEL PRODUCT, AND USE OF A FLAT STEEL PRODUCT OF SAID TYPE

(71) Applicants: ThyssenKrupp Steel Europe AG, Duisburg (DE); ThyssenKrupp Rasselstein GmbH, Andernach (DE)

(72) Inventors: Erhard Holleck, Duisburg (DE); Eberhard Sowka, Dinslaken (DE); Burkhard Kaup, Andernach (DE); Stephan Schiester, Andernach (DE)

(73) Assignees: THYSSENKRUPP STEEL EUROPE AG, Duisburg (DE); THYSSENKRUPP RASSELSTEIN GMBH, Andernach (DE)

( * ) Notice: Subject to any disclaimer, the term of this patent is extended or adjusted under 35 U.S.C. 154(b) by 379 days.

(21) Appl. No.: 14/772,788

(22) PCT Filed: Mar. 6, 2014

(86) PCT No.: PCT/EP2014/054368
§ 371 (c)(1),
(2) Date: Sep. 4, 2015

(87) PCT Pub. No.: WO2014/135645
PCT Pub. Date: Sep. 12, 2014

(65) Prior Publication Data

US 2016/0010172 A1 Jan. 14, 2016

(30) Foreign Application Priority Data

Mar. 7, 2013 (DE) ..... 10 2013 102 273

(51) Int. Cl.

| | |
|---|---|
| ***C21D 8/04*** | (2006.01) |
| ***C21D 9/48*** | (2006.01) |
| ***C22C 38/02*** | (2006.01) |
| ***C22C 38/04*** | (2006.01) |
| ***C22B 9/04*** | (2006.01) |
| ***C22B 9/10*** | (2006.01) |
| ***B22D 11/00*** | (2006.01) |
| ***B22D 11/113*** | (2006.01) |
| ***B22D 11/116*** | (2006.01) |
| ***B21B 1/22*** | (2006.01) |
| ***B22D 11/12*** | (2006.01) |
| ***B22D 11/126*** | (2006.01) |
| ***B22D 11/14*** | (2006.01) |
| ***C21D 1/26*** | (2006.01) |
| ***C21D 6/00*** | (2006.01) |
| ***C22C 38/00*** | (2006.01) |
| ***C22C 38/06*** | (2006.01) |

(Continued)

(52) U.S. Cl.
CPC ..... *C21D 8/0436* (2013.01); *B21B 1/22* (2013.01); *B22D 11/1206* (2013.01); *B22D 11/126* (2013.01); *B22D 11/14* (2013.01); *C21D 1/26* (2013.01); *C21D 6/005* (2013.01); *C21D 6/008* (2013.01); *C21D 8/041* (2013.01); *C21D 8/0426* (2013.01); *C21D 8/0463* (2013.01); *C22B 9/04* (2013.01); *C22B 9/10* (2013.01); *C22C 38/001* (2013.01); *C22C 38/004* (2013.01); *C22C 38/02* (2013.01); *C22C 38/04* (2013.01); *C22C 38/06* (2013.01); *C25D 5/36* (2013.01); *B21B 1/46* (2013.01); *B21D 35/005* (2013.01); *B21D 51/26* (2013.01)

(58) Field of Classification Search
None
See application file for complete search history.

(56) References Cited

U.S. PATENT DOCUMENTS 6,767,415 B1 7/2004 Sardoy et al.
2012/0177935 A1* 7/2012 Richards ..... C21C 7/06 428/457

FOREIGN PATENT DOCUMENTS

CN 101941021 A 1/2011
CN 102575308 A 7/2012
(Continued)

OTHER PUBLICATIONS

Machine-English translation of JP2003-181602 A, Kanai Tatsuo, Jul. 2, 2003.*

(Continued)

*Primary Examiner* — Deborah Yee
(74) *Attorney, Agent, or Firm* — The Webb Law Firm

(57) ABSTRACT

A method is disclosed for the operationally reliable production of a cold-rolled flat steel product of ≤0.5 mm in thickness for deep-drawing and ironing applications. In the method, a steel melt which (in wt %) comprises up to 0.008% C, up to 0.005% Al, up to 0.043% Si, 0.15-0.5% Mn, up to 0.02% P, up to 0.03% S, up to 0.020% N and in each case optionally up to 0.03% Ti and up to 0.03% Nb and, as a remainder, iron and unavoidable impurities, is, with the omission of a Ca treatment, subjected to a secondary metallurgical treatment which, in addition to a vacuum treatment, comprises a ladle furnace treatment and during which the steel melt to be treated is kept under a slag, the Mn and Fe contents of which are, in sum total, <15 wt %. From the steel melt, a thin slab or a cast strip are produced, which are subsequently hot-rolled to form a hot strip with a thickness of <2.5 mm and wound to form a coil. Subsequently, the hot strips are cold-rolled to form a flat steel product of up to 0.5 mm in thickness.

17 Claims, No Drawings

(51) Int. Cl.

| | |
|---|---|
| ***C25D 5/36*** | (2006.01) |
| *B21B 1/46* | (2006.01) |
| *B21D 35/00* | (2006.01) |
| *B21D 51/26* | (2006.01) |

(56) References Cited

FOREIGN PATENT DOCUMENTS

| | | | | | |
|---|---|---|---|---|---|
| DE | 69806312 | T2 | | 3/2003 | |
| EP | 0351762 | A2 | * | 1/1990 | ..... C21C 7/06 |
| EP | 0811081 | B1 | | 12/1997 | |
| EP | 0896069 | A1 | | 2/1999 | |
| JP | 2003-181602 | A | * | 7/2003 | ..... B22D 11/00 |
| JP | 2004323905 | A | | 11/2004 | |
| RU | 2320732 | C1 | | 3/2008 | |
| WO | 2011012242 | A1 | | 2/2011 | |

OTHER PUBLICATIONS

Bald et al., Innovative Technologie zur Banderzeugung [Innovative Technology for Strip Production], Stahl und Eisen [Steel and Iron], Sep. 1999, pp. 77-85, vol. 119, No. 9.

Hendricks et al., Inbetriebnahme und erste Ergebnisse der GieBwalzanlage der Thyssen Krupp Stahl AG [Commissioning and First Results of the Casting Rolling Plant of Thyssen Krupp Stahl AG], Stahl und Eisen [Steel and Iron], Feb. 2000, pp. 61-68, vol. 120, No. 2.

* cited by examiner

METHOD FOR PRODUCING A COLD-ROLLED FLAT STEEL PRODUCT FOR DEEP-DRAWING AND IRONING APPLICATIONS, FLAT STEEL PRODUCT, AND USE OF A FLAT STEEL PRODUCT OF SAID TYPE

CROSS-REFERENCE TO RELATED APPLICATIONS

This application is the United States national phase of International Application No. PCT/EP2014/054368 filed Mar. 6, 2014, and claims priority to German Patent Application No. 10 2013 102 273.1 filed Mar. 7, 2013, the disclosures of which are hereby incorporated in their entirety by reference.

BACKGROUND OF THE INVENTION

Field of the Invention

The invention relates to a method for producing a cold-rolled flat steel product of up to 0.5 mm thickness for the deep-drawing and ironing applications. The invention also relates to a flat steel product produced in accordance with a method of said type, and to an advantageous use of a corresponding flat steel product.

Description of Related Art

Methods of the type in question here are performed on so-called "casting-rolling plants", abbreviated to "CRP", in which the casting of the steel to form a strand and the subsequent rolling processes during the hot strip production are coordinated with one another such that a continuous sequence of casting and rolling processes is possible. In this way, the outlay involved in conventional slab manufacturing for the re-heating and pre-rolling processes can be avoided.

In casting-rolling plants, the steel is cast to form a continuously drawn-off strand, from which thin slabs are subsequently severed off "in line", said thin slabs then being subjected, likewise "in line", to hot rolling to form hot strip. Experience gained from the operation of casting-rolling plants and the advantages of the casting-rolling process are documented for example in W. Bald et al. "Innovative Technologie zur Banderzeugung" ["Innovative technology for strip production"], Stahl und Eisen [Steel and Iron] 119 (1999) no. 9, pages 77-85, or C. Hendricks et al. "Inbetriebnahme und erste Ergebnisse der Gießwalzanlage der Thyssen Krupp Stahl AG" ["Commissioning and initial results of the casting-rolling plant of Thyssen Krupp Stahl AG"], Stahl und Eisen [Steel and Iron] 120 (2000) no. 2, pages 61-68. With casting-rolling plants that are available nowadays, it is possible to produce hot strips with hot-strip thicknesses of less than 3 mm.

Despite the method advantages offered by conventional casting-rolling plants, it has not been possible, since the large-scale introduction of such plants, for steels which, with regard to their deformation characteristics, exhibit isotropy which is adequate for deep-drawing and ironing applications to be produced with the required reliability by way of thin-slab strand casting plants or the associated casting-rolling plants. It has been found that conventional thin slabs cast from aluminum-killed steels, and hot strips produced therefrom, are not suitable for products with extremely high demands with regard to degree of purity and surface quality. It has therefore not been possible in the past for hot strip intended in particular for the production of tinplate with a typical thickness of at most 0.5 mm, in particular at most 0.251 mm, to be produced on a casting-rolling plant. Tinplate of such thickness is required for example for the production of beverage cans or the like. The situation is even more critical if it is intended to use a casting-rolling plant to produce precursor material for packaging steel of up to 0.1 mm, in particular of up to 0.06 mm, in thickness.

The reasons for the problems in the production of very thin cold-rolled flat steel products intended for deep-drawing and ironing applications by way of a CRP are known per se. In the case of thin slab strand casting or strip casting of Al-killed steels, with Al contents typically in the range from 0.010-0.060 wt %, a calcium treatment of the steel melt in the steel factory is required in order to prevent clogging of the dip tubes required for the casting process by aluminum oxide inclusions. In this case, it is necessary for the liquid calcium aluminates with contents of approximately 50% CaO and 50% $Al_2O_3$ to be produced in a reproducibly reliable manner in the steel melt.

If this inclusion composition is not achieved with adequate accuracy and there is a significant shortage or excess of CaO in the non-metallic inclusions, or spinel inclusions (with MgO fraction) form, pronounced clogging occurs, with intensified bath level fluctuations in the mold, during the strand casting despite the Ca treatment. Such a situation leads to casting slag being inducted into the cast strand, resulting in a generally lower degree of purity and increased superficial defects on the strand surface. As a result, inadequate setting of the CaO and $Al_2O_3$ inclusions during the production of hot strip by way of a casting-rolling plant therefore leads to a deterioration of the internal condition and surface condition of the thin slabs severed off from the strand thus cast, and thus of the hot strip that is in each case hot-rolled from said thin slabs.

The same problem arises in strip casting plants in which the steel melt is cast to form cast strip and is subsequently rolled, in-line, to form a hot strip.

In the case of thin-slab strand casting or strip casting, it is therefore important to achieve a very good non-metallic degree of purity already by way of the secondary metallurgy. By contrast to conventional slab casting, it is not possible either in the case of strand casting or in the case of strip casting, owing to the considerably higher casting speeds, for the inclusions (oxides, sulfides) contained in the cast steel melt to rise in the mold and be deposited in the casting slag. By contrast to the aluminum oxide inclusions that are common during conventional production, the calcium aluminate inclusions that form in calcium-treated melts and which remain in the slab or thin slab during the strand casting process are also not broken down during the course of the hot-rolling process, but rather maintain their size. The same applies to strip casting. Therefore, in the case of cold-rolling or deformation processes, macroscopic Ca-aluminate inclusions can result, for example, in superficial defects on the product surface, or in holes in the rolled material in particular in the case of very thin finished material.

Against this background, WO 2011/012242 A1 has proposed a method for producing a steel strip or sheet from a ULC steel, in which method a steel melt is cast to form a slab or a cast strip which (in wt %) comprise ≤0.003% C, 0.5-0.35% Mn, <0.025% P, <0.020% S, <0.004% Si, ≤0.002 Al, <0.004% N, a total of ≤0.1% Cr, Cu, Ni, Sn and Mo, ≤0.004% N, in each case ≤0.005% Nb, Ti, Zr and V, ≤0.0030% B and, as a remainder, Fe and unavoidable impurities.

To produce an alloy with this purity, it is the case in the known method that the steel melt, after the melting thereof, is subjected initially to a vacuum treatment and then to a ladle furnace treatment. Here, the purpose of the ladle furnace treatment is in particular to set a minimized oxygen and aluminum content in each case in the thin slab obtained after the casting process or in the cast strip obtained after the casting process. Here, the oxygen activity of the steel melt should be as low as possible for the strand casting process or the strip casting process in order to prevent the formation of pores in the cast product and casting defects. Here, the setting of the oxygen content or of the oxygen activity is realized by way of targeted metering of aluminum in an amount which is determined in a manner dependent on the result of monitoring of the present oxygen activity of the melt with regard to the aim of achieving that the oxygen content of the melt lies below 100 ppm at the end of the ladle furnace treatment.

Aside from the high technical demands that arise from permanent monitoring of the oxygen content of a melt, practical experience in the production of very thin cold-rolled flat steel products for deep-drawing and ironing applications ("tinplate") gives reason to expect that measures which go beyond the prior art discussed above are necessary in order, in the case of production by way of a casting-rolling plant or a strip casting plant, to ensure the very good non-metallic degree of purity of the steel melt for a flat steel product with optimum deep-drawing and ironing suitability.

SUMMARY OF THE INVENTION

The object of the invention was therefore that of specifying a method with which, in an operationally reliable manner, it is possible, from thin slabs or cast strip, to produce a thin, cold-rolled flat steel product, of at most 0.5 mm in thickness, which meets even the highest demands with regard to its deep-drawing and ironing suitability. Furthermore, it is sought to specify a corresponding flat steel product and a particularly expedient use of such a flat steel product.

With regard to the method, said object is achieved according to the invention in that, in the production of cold-rolled flat steel products of up to 0.5 mm in thickness for deep-drawing and ironing applications, the working steps specified in claim 1 are carried out.

With regard to the flat steel product, the abovementioned object is correspondingly achieved by virtue of such a flat steel product being produced in the manner according to the invention.

A flat steel product produced according to the invention in this way is particularly well-suited to deep-drawing applications in which the ear heights, determined in accordance with ISO 15131, lie in the range from 0.2-0.7 mm in the case of a deep-drawing ratio ß of 1.8 and a cup diameter of 33 mm. Such ratios exist in particular in the case of so-called "twist-off closures" and "DRD cans", but also generally in the case of thin-walled beverage cans.

DESCRIPTION OF THE INVENTION

In the method according to the invention for producing a cold-rolled flat steel product of up to 0.5 mm in thickness for deep-drawing and ironing applications, it is provided that, in working step a), a metal melt is produced which (in wt %) comprises up to 0.008% C, up to 0.005% Al, up to 0.043% Si, 0.15-0.5% Mn, up to 0.02% P, up to 0.03% S, up to 0.020% N and in each case optionally up to 0.03% Ti and up to 0.03% Nb and, as a remainder, iron and unavoidable impurities, the contents of which are to be attributed to up to 0.08% Cr, up to 0.08% Ni, up to 0.08% Cu, up to 0.02% Sn, up to 0.01% Mo, up to 0.0020% V, up to 0.007% B, up to 0.05% Co and up to 0.0060% Ca. In practice, the S contents of the melt according to the invention typically lie in the range from 0.005-0.03 wt %. At the same time, in a practical implementation of the invention, the Al content of the melt is typically at least 0.001 wt %. With regard to the working results sought according to the invention, optimum Al contents of the steel melt that is ready for casting lie in the range from 0.001-0.002 wt %.

In order to ensure, on the one hand, good castability and, on the hand, optimum purity of the strand or strip to be cast from said steel melt, the steel melt is, with the omission of a Ca treatment, subjected to a secondary metallurgical treatment which, in addition to a vacuum treatment, comprises a ladle furnace treatment. During the ladle furnace treatment, the steel melt to be treated is kept under a slag, the Mn content % Mn and Fe content % Fe are defined by % Mn+% Fe<15 wt %, in particular <9 wt %.

The measures provided according to the invention in the production of the steel melt are based on the realization that, for good absorption of non-metallic inclusions in the melt, the ladle slag must be kept in a free-flowing state. This cannot be achieved by conventional vacuum treatment in an RH or DH plant. However, in the case of the ladle furnace treatment specified according to the invention, the ladle slag can be intensively liquefied by heating using electrodes. Said ladle slag is consequently very well suited to absorbing non-metallic inclusions that rise to the bath surface, and thus to further improving the degree of purity of the steel melt after the vacuum treatment process.

For the success of the method according to the invention, it is also of particular importance that, during the vacuum treatment and the subsequent ladle furnace treatment, a slag is kept in contact with the steel melt, which slag has had a particular oxygen potential already set therein before the vacuum treatment. This oxygen potential "$a_o$-Slag" of the ladle slag must be coordinated with the required oxygen activity "$a_o$-Melt" of the steel melt. If the oxygen activity $a_o$-Slag is too high, this results in the unfavorable situation whereby, as a result of the tendency for equilibrium to be established between the slag and steel melt, too much oxygen is transported out of the slag into the steel melt. This exchange would result in an excessively high oxygen activity $a_o$-Melt of for example 120 ppm, in particular 100 ppm, such that increased aluminum oxide or aluminum oxide-manganese oxide inclusions form by way of reaction products with the steel melt. As a result, the degree of purity of the steel melt would accordingly be reduced. Furthermore, in the case of excessive oxygen absorption into the melt, the problem arises that, then, the optimum oxygen activity $a_o$-Melt can no longer be set without contravening the requirements "ensuring the lowest contents of dissolved $Al_{sol}$", that is to say target contents for $Al_{sol}$ of in particular less than 0.0020 wt %, on the one hand, and "effecting an adequately partially killed state without pore formation during the strand casting process", on the other hand. This can be explained from the fact that the metered Al amount required for setting a target range of the oxygen activity $a_o$-Melt of 40-60 ppm, which is regarded as being optimum, would be so high as to result in an excessively high Al content in the steel melt, and in association therewith, an unfavorable non-metallic degree of purity. As a result of this, the deep-drawing and ironing suitability of the flat steel product to be produced would be impaired in an inadmissible manner which no longer satisfies the requirements of modern deformation processes, such as for example the DWI process.

As an indirect measure for the oxygen activity $a_o$-Slag, the Fe content % Fe and Mn content % Mn of the ladle slag can be taken into consideration. By virtue of the sum % Fe+% Mn of the Fe and Mn contents of the ladle slag being set to less than 15 wt %, in particular <9 wt %, it is ensured that the oxygen activity "$a_o$-Melt" can be set in the optimum range of 40-60 ppm, without the need for a continuous measurement of the oxygen content of the slag to be performed for this purpose. This applies in particular if the Fe content % Fe of the ladle slag is defined as follows: % Fe<10 wt %, in particular % Fe<6 wt %.

The steel melt produced in the manner according to the invention is, in working step b), continuously cast to form a strand, from which one or more thin slabs are then severed off in the conventional manner, said thin slabs subsequently being supplied for further processing in a continuous process sequence. Alternatively, the melt produced in the manner according to the invention may be cast to form a cast strip, for example by means of a two-roller strip casting apparatus or in accordance with the DSC method.

The cast precursor product which is obtained in this way and which is present in the form of a thin slab or a cast strip is then, in working step c), hot-rolled in the conventional manner to form a hot strip which has a thickness of less than 2.5 mm, in particular less than 2.3 mm, wherein hot strip thicknesses of less than 2 mm have proven to be particularly expedient with regard to further processing. If required, the respective precursor product may, before the hot rolling, be brought to a temperature of 1000-1250° C., which is optimum for the further process sequence. This may be realized for example by targeted cooling of the respective cast precursor product, which in this case is still too hot for the hot-rolling process, or by way of targeted heating of the precursor product, which in this case has cooled down to an excessive degree. If appropriate, it may also be expedient for the respective cast precursor product to be subjected to heat treatment in order to homogenize its temperature distribution before the hot-rolling process begins. The hot-rolling process itself is optimally started with a hot-rolling start temperature which lies in the range from 950-1200° C., and ended with a hot-rolling end temperature which lies in the range from 800-950° C.

After the hot-rolling process, the hot strip that is obtained is, in the conventional manner, wound to form a coil at a winding temperature which is typically 500-750° C.

After the killing in the coil, the hot strip is cold-rolled to form the cold-rolled flat steel product of up to 0.5 mm, in particular at most 0.26 mm, in thickness. The cold-rolling process may be preceded by a surface treatment process in which, in the conventional manner, cinders and other contaminants adhering to the hot strip are mechanically or chemically removed.

The cold-rolling process itself may be performed in one or more stages. In the case of a multi-stage cold-rolling process, recrystallization annealing may be performed between the cold-rolling stages. In the case of a cold-rolling process performed in two stages, the first stage of the cold-rolling process should be performed with a degree of deformation of more than 85%, in particular more than 90%, and the second stage of the cold-rolling process should be performed with a degree of deformation of 0.4-50%, in particular at least 1%, wherein degrees of deformation of 4-42% are particularly practical.

Finally, the cold-rolled flat steel product that is obtained may be provided with a protective coating for protection against corrosive attack. For this purpose, the cold-rolled flat steel products according to the invention may be coated with a metallic protective layer. For this purpose, said flat steel product may for example be subjected to electrolytic tin plating.

With the method according to the invention, it is thus possible for the disadvantages based on degree of purity that arise in the prior art in the production of particularly thin cold-rolled flat steel products, which are intended for deep-drawing and ironing applications, by way of thin slab strand casting and other casting or casting-rolling processes that yield similar final dimensions to be eliminated by virtue of the flat steel products being produced on the basis of an alloy concept with minimized Al contents. With such low Al contents, it is possible to dispense with a Ca treatment of the melt, such that the formation of calcium aluminates, which are detrimental to the deformation characteristics, is prevented.

Flat steel products produced according to the invention accordingly satisfy extremely high demands with regard to their deformability. They are suitable for all deformation applications for which earing, as defined in accordance with ISO 11531, of less than 0.86 mm is demanded. In particular, flat steel products according to the invention are suitable for deformation applications which are critical with regard to earing, and for demanding deep-drawing and ironing applications in which the earing, as defined in accordance with ISO 11531, should amount to less than 0.7 mm.

Owing to their particularly good deformability obtained by way of the production method according to the invention, flat steel products produced according to the invention are particularly suitable for the production of packaging for loose goods. Such packaging is typically in the form of cans and similar containers which are used for the packaging of foodstuffs, beverages, animal feed and other pourable, flowable or fluid goods and products. Such goods and products also generally include, for example, chemical or biological products such as gases or aerosols. Flat steel products according to the invention may likewise be used for the production of caps for such containers, crown caps for the closure of bottles, or spray cans.

On the basis of the method according to the invention for producing the steel melt, a very good non-metallic degree of purity of the hot strip is obtained, which is the prerequisite for an optimum cold-rolled flat steel product of the type according to the invention. Accordingly, tinplate which is produced in the manner according to the invention, and which is for example 0.13 mm in thickness, for the intended usage "production of twist-off closures", which is particularly critical with regard to degree of purity, exhibited only a minimal number of inclusions with a diameter of greater than 70 μm in tests by way of eddy current and magnetic powder. The flat steel product material created in this way thus satisfied the stringent demands with regard to degree of purity for said critical usage. By contrast, flat steel products produced, for comparative purposes, from conventional Al-killed LC steel with an Al content of 0.033 wt % had a degree of purity which was not suitable for tinplate.

At the same time, the comparative tests proved that, in the casting of an Al-free ULC steel melt produced according to the invention, clogging effects during the thin slab strand casting were only minor, such that not only the degree of purity but also the surface condition of the hot strips cast from the thin slabs satisfied the high demands placed on hot strips suitable for the production of tinplate.

By means of the metallurgical treatment according to the invention, the composition of the oxidic micro-inclusions (size range <10 μm) that remain in the steel melt is changed in relation to aluminum killing and manufacturing by way of a conventional strand casting plant. The minimization, attained according to the invention, of the fraction of hard $Al_2O_3$ particles in the microstructure of a flat steel product according to the invention leads, in the production of deep-drawn or ironed products composed of a cold-rolled flat steel product produced according to the invention, not only to optimum deformation behavior of the material but also to a considerable increase in the service life of the deformation tool used in each case. Furthermore, owing to the low Al content, the nitrogen in the steel is not bound as AlN, but rather is present substantially in interstitially dissolved form. This yields considerably greater hardening potential.

To prove the effect of the invention, three tests E1, E2 and E3 were carried out in which the melt cast in each case to form thin slabs was subjected to secondary metallurgical treatment in the manner according to the invention. For comparison, three further tests V1, V2 and V3 were carried out in which the ladle furnace treatment according to the invention was dispensed with in each case.

| Evaluation | Identifier | Number of inclusions per $m^2$ |
|---|---|---|
| Very good | + | <0.5 |
| Satisfactory | 0 | 0.6-3.0 |
| Unsatisfactory | – | >3.0 |

Samples evaluated as "very good" may for example be used without restriction for all packaging steel applications. Samples evaluated as "satisfactory" may be used for particular, non-critical packaging steel applications. Samples evaluated as "unsatisfactory" are basically unsuitable for packaging steel applications.

In each of the tests E1-E3 and V1-V3, the hot strips obtained were, after the winding process, passed through a pickle and were then cold-rolled in two stages. After a first cold-rolling process, the flat steel products were in this case subjected to recrystallization annealing at a temperature of in each case 700° C. in a continuous furnace, and were subsequently finished by cold-rolling, with a degree of cold-rolling of 38%, to a final thickness of 0.13 mm. Subsequently, the flat steel products cold-rolled in this way were subjected to electrolytic tin plating.

TABLE 1

| | | | E1 | E2 | E3 | V1 | V2 | V3 |
|---|---|---|---|---|---|---|---|---|
| Chemical analysis | C | [ppm] | 34 | 34 | 34 | 30 | 30 | 30 |
| | N | [ppm] | 23 | 23 | 23 | 20 | 20 | 20 |
| | Mn | [ppm] | 2400 | 2400 | 2400 | 2500 | 2500 | 2500 |
| | Al | [ppm] | 20 | 20 | 20 | 20 | 20 | 20 |
| | Al sol. | [ppm] | <10 | <10 | <10 | <10 | <10 | <10 |
| | Si | [ppm] | 80 | 80 | 80 | 100 | 100 | 100 |
| | O | [ppm] | 50 | 50 | 50 | 55 | 55 | 55 |
| | Cr | [ppm] | 240 | 240 | 240 | 210 | 210 | 210 |
| | Ni | [ppm] | 130 | 130 | 130 | 140 | 140 | 140 |
| | Cu | [ppm] | 130 | 130 | 130 | 130 | 130 | 130 |
| | P | [ppm] | 70 | 70 | 70 | 80 | 80 | 80 |
| | S | [ppm] | 62 | 62 | 62 | 78 | 78 | 78 |
| Hot rolling | Hot strip thickness | [mm] | 1.8 | 2.0 | 1.6 | 1.6 | 1.8 | 2.0 |
| | End temperature | [° C.] | 871 | 880 | 861 | 870 | 880 | 865 |
| | Winding temperature | [° C.] | 623 | 584 | 584 | 601 | 603 | 590 |
| Cold strip | End thickness | [mm] | 0.13 | 0.13 | 0.13 | 0.13 | 0.13 | 0.13 |
| Characteristic values | Yield strength (200° C., 20 min) | [MPa] | 570 | 580 | 565 | 569 | 575 | 580 |
| | Tensile strength (200° C., 20 min) | [MPa] | 580 | 585 | 572 | 579 | 580 | 588 |
| | Ear height (β = 1.8, cup = 33 mm) | [mm] | <0.86 | <0.86 | <0.86 | <0.86 | <0.86 | <0.86 |
| Internal degree of purity: | | | + | 0 | + | – | – | – |

The composition of the steel melt processed in each case, the parameters used in the hot-rolling and cold-rolling processes, and the characteristic values of significance for the deep-drawing suitability are stated in table 1.

Also recorded in table 1 is an evaluation of the internal degree of purity of the tested samples. The degree of purity was in this case determined, by means of electromagnetic measurement methods over the entire volume, on the basis of the number of non-metallic inclusions with an extent of >70 μm before the finishing process, which may for example consist in the application of a metallic coating such as tin plating or chromium plating. The classification was made on the basis of the number of inclusions per $m^2$, as per the following specification:

The invention claimed is:

1. A method for producing a cold-rolled flat steel product of up to 0.5 mm in thickness for deep-drawing and ironing applications, comprising the following working steps:

a) producing a metal melt which (in wt %) comprises up to 0.008% C, up to 0.005% Al, 0.008-0.043% Si, 0.15-0.5% Mn, up to 0.02% P, up to 0.03% S, up to 0.020% N and in each case optionally up to 0.03% Ti and up to 0.03% Nb and, as a remainder, iron and unavoidable impurities, the contents of which are to be attributed to up to 0.08% Cr, up to 0.08% Ni, up to 0.08% Cu, up to 0.02% Sn, up to 0.01% Mo, up to 0.0020% V, up to 0.007% B, up to 0.05% Co and up to 0.0060% Ca, wherein the metal melt is, with the omission of a Ca treatment, subjected to a secondary metallurgical treatment which, in addition to a vacuum treatment, comprises a ladle furnace treatment and during which the steel melt to be treated is kept under a slag, the Mn content % Mn and Fe content % Fe of the slag defined by $$\% Mn + \% Fe < 15 \text{ wt } \%;$$

b) continuously casting the metal melt to form a strand, and severing a thin slab from the strand, or to form a cast strip;

c) hot-rolling the thin slab or the cast strip to form a hot strip with a thickness of less than 2.5 mm;

d) winding the hot strip to form a coil; and e) cold-rolling the hot strip to form the cold-rolled flat steel product of up to 0.5 mm in thickness.

2. The method as claimed in claim 1, wherein the Al content of the steel melt amounts to at most 0.002 wt %.

3. The method as claimed in claim 1, wherein the Fe content % Fe of the slag under which the steel melt is kept during the ladle furnace treatment amounts to less than 10 wt %.

4. The method as claimed in claim 1, wherein the oxygen content of the steel melt at the end of the ladle furnace treatment lies below 100 ppm.

5. The method as claimed in claim 1, wherein the thin slab is, before the hot rolling, brought to a temperature of 1000-1250° C.

6. The method as claimed in claim 1, wherein the hot-rolling start temperature of the thin slab at the start of the hot-rolling process is 950-1200° C.

7. The method as claimed in claim 1, wherein the hot-rolling end temperature of the hot strip at the end of the hot-rolling process is 800-950° C.

8. The method as claimed in claim 1, wherein the hot strip is wound at a winding temperature of 500-750° C.

9. The method as claimed in claim 1, wherein the thickness of the cold-rolled flat steel product amounts to less than 0.26 mm.

10. The method as claimed in claim 1, wherein the cold rolling is performed in at least two stages, and the cold-rolled flat steel product is subjected to recrystallization annealing between the stages of the cold-rolling process.

11. The method as claimed in claim 10, wherein the degree of deformation achieved by way of the first stage of the cold-rolling process is greater than 85%, and the degree of deformation achieved by way of the second stage of the cold-rolling process amounts to 0.4-50%.

12. The method as claimed in claim 1, wherein the cold-rolled flat steel product is subjected to electrolytic tin plating.

13. A flat steel product produced through the use of the method configured as claimed in claim 1.

14. A method of producing a steel container comprising forming at least a portion of the steel container from the flat steel product as claimed in claim 13.

15. A flat steel product as claimed in claim 13, wherein earing of the flat steel product, as defined in accordance with ISO 11531, is <0.86 mm.

16. The method as claimed in claim 14, wherein the container is a can for foodstuffs, animal feed, beverages or other filling materials, an aerosol can or a spray can.

17. The method as claimed in claim 16, wherein the filling materials are chemical or biological products.

* * * * *